US005833519A

United States Patent [19]

Moore

[11] Patent Number: 5,833,519

[45] Date of Patent: Nov. 10, 1998

[54] METHOD AND APPARATUS FOR MECHANICAL POLISHING

[75] Inventor: Scott E. Moore, Meridian, Id.

[73] Assignee: Micron Technology, Inc., Boise, Id.

[21] Appl. No.: 695,763

[22] Filed: Aug. 6, 1996

[51] Int. Cl.[6] ..... B24B 53/00

[52] U.S. Cl. ..... 451/56; 451/443

[58] Field of Search ..... 451/444, 443, 451/56, 10, 11, 24

[56] References Cited

U.S. PATENT DOCUMENTS

| | | | |
|---|---|---|---|
| 5,154,021 | 10/1992 | Bombardier | 51/262 |
| 5,245,794 | 9/1993 | Salugsugan | 51/165.74 |
| 5,299,393 | 4/1994 | Chandler et al. | 51/272 |
| 5,384,986 | 1/1995 | Hirose et al. | 451/444 |
| 5,399,234 | 3/1995 | Yu et al. | 156/636 |
| 5,413,941 | 5/1995 | Koos et al. | 437/8 |
| 5,456,627 | 10/1995 | Jackson et al. | 451/56 |
| 5,486,131 | 1/1996 | Cesna et al. | 451/444 |
| 5,531,635 | 7/1996 | Mogi et al. | 451/443 |

*Primary Examiner*—Robert A. Rose
*Attorney, Agent, or Firm*—W. Eric Webostad

[57] ABSTRACT

Method and apparatus for conditioning a polishing pad. In particular, a check loop system and associated code are described for monitoring force applied on a pad from an end effector attached to an arm. The pad is conditioned by the end effector for mechanical polishing to remove matter from a substrate assembly. This may be done with chemical-mechanical-polishing and is often used for planarization of a substrate assembly. Described are a modular turret and drive system which are used to manipulate an end effector over a pad.

22 Claims, 14 Drawing Sheets

METHOD AND APPARATUS FOR MECHANICAL POLISHING

TECHNICAL FIELD OF THE INVENTION

The present invention relates generally to, and more particularly to mechanical polishing, and relates particularly to pad conditioning for chemical-mechanical polishing for planarization and/or removal of material from one or more substrate assemblies.

BACKGROUND OF THE INVENTION

The increasingly deformed planar surfaces of semiconductor devices has led to development of technology known as chemical-mechanical-polishing (CMP). CMP is used to primarily planarize or remove a portion of a surface of a substrate assembly. By substrate assembly, it should be understood to include a substrate or wafer, as well as a substrate having one or more layers formed thereon.

In U.S. Pat. No. 5,456,627, entitled "Conditioner for a Polishing Pad and Method Therefor," to Jackson et al., method and apparatus for conditioning a pad used for polishing a silicon wafer are described. In U.S. Pat. No. 5,399,234, entitled "Acoustically Regulated Polishing Process" to Yu et al., method for polish planarizing a material layer in a semiconductor device using a CMP apparatus is described. In U.S. Pat. No. 5,413,941, entitled "Optical End Point Detection Methods in Semiconductor Planarizing Polishing Processes" to Koos et al., optical end point detection methods for semiconductor planarizing polishing processes employing CMP are described. In U.S. Pat. No. 5,299,393, entitled "Slurry Containment Device for Polishing Semiconductor Wafers" to Chandler et al., a device for containing an abrasive slurring on a rotating polishing table for CMP is described. In U.S. Pat. No. 5,245,794, entitled "Audio End Point Detection for Chemical-Mechanical Polishing and Method Therefor" to Salugsugan, a device for detecting the planar end point in a semiconductor wafer during CMP is described. In U.S. Pat. No. 5,154,021, entitled "Pneumatic Pad Conditioner" to Bombardier et al., process and apparatus for raising flattened fibers on a pad designed for CMP and for removing polishing by-products and spent polishing material from the surface of a pad employed for CMP are described. All the aforementioned patents are incorporated by reference as though set forth fully herein. However, reliability, serviceability, and down force and positional accuracy are areas for improvement associated with mechanical polishing.

SUMMARY OF THE INVENTION

The present invention provides method and apparatus for mechanical polishing. In particular, the present invention facilitates pad conditioning for chemical-mechanical polishing for removal of material from one or more substrate assemblies. Such removal of material may be used for planarizing a surface of such assemblies.

The present invention provides a system for positioning, ramping and forced checks. The system is employed to control application of an end effector device. The end effector device is controlled by a microcomputer by the use of a control and feedback paths. The control path includes a regulator and an actuator. The feedback loop includes a transducer for supplying force information to the microcomputer.

The present invention also provides an upper subassembly. The upper subassembly delivers force as applied to an end effector device. The upper subassembly also includes a lever arm for facilitating an increase in range of motion of an end effector device, and eliminates need for an independent device to raise and lower such arm. The upper subassembly may be rotated for positioning the lever arm, and thus end effector, as desired.

The present invention also provides a lower subassembly. The lower subassembly is a substantially direct drive for the upper subassembly, in which the upper subassembly may be rotated through such drive. The lower subassembly includes a drive shaft having attached thereto a clamp and flag assembly. The clamp and flag assembly couple a gearbox to a shaft, while also providing indexing for the position of the shaft and limiting rotation of the shaft.

The upper and lower subassemblies in combination form a conditioner in accordance with the present invention. The conditioner of the present invention is mechanically simplified over prior conditioners. In particular, the present invention facilitiates modular design for improved reliability, maintenance, and reduction in contamination generation. The present invention provides greater accuracy, repeatability and precision over prior conditioners. The present invention further provides improved tracking of end effector force by a reduction ratio to reduce effect of friction forces.

Other features and embodiments of the present invention are described or are apparent from reading the detailed description or by practicing the present invention.

BRIEF DESCRIPTION OF THE DRAWINGS

The features of the present invention, as well as objects and advantages, will best be understood by reference to the appended claims, detailed description of particular embodiments and accompanying drawings where:

DETAILED DESCRIPTION OF THE PREFERRED EMBODIMENTS

Figure 1A:
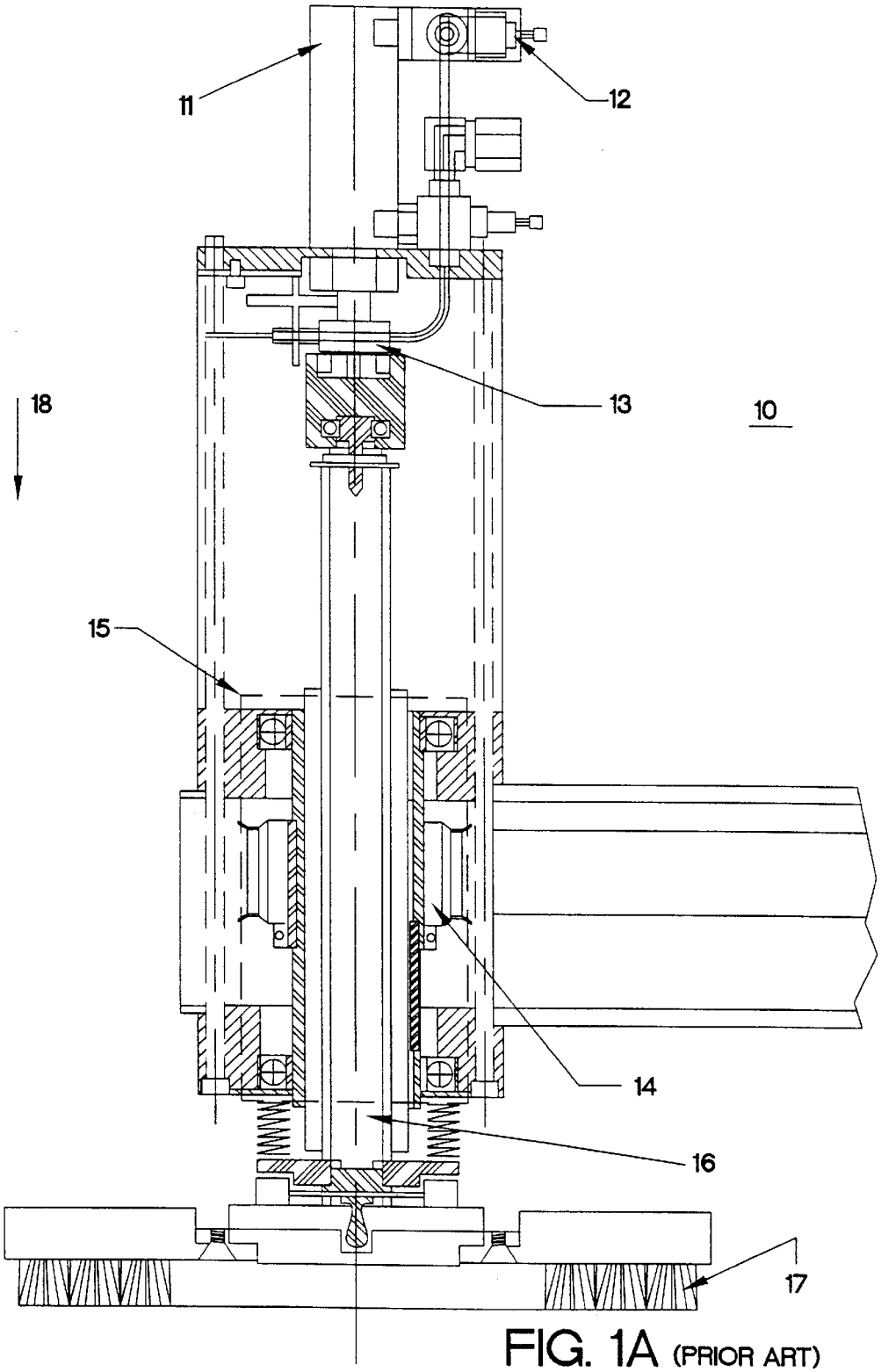
FIG. 1A (PRIOR ART)
FIG. 1A is a cross-sectional view of a conditioner assembly prior to the present invention.
Figure 1B:
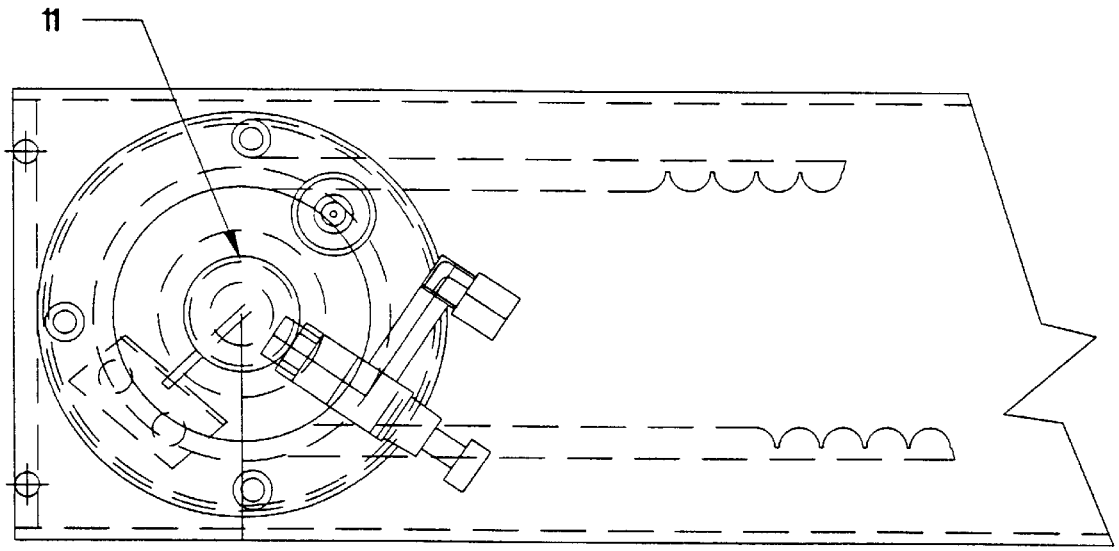
FIG. 1B (PRIOR ART)
FIG. 1B is a top elevation view of the conditioner assembly of FIG. 1A.
Figure 1C:
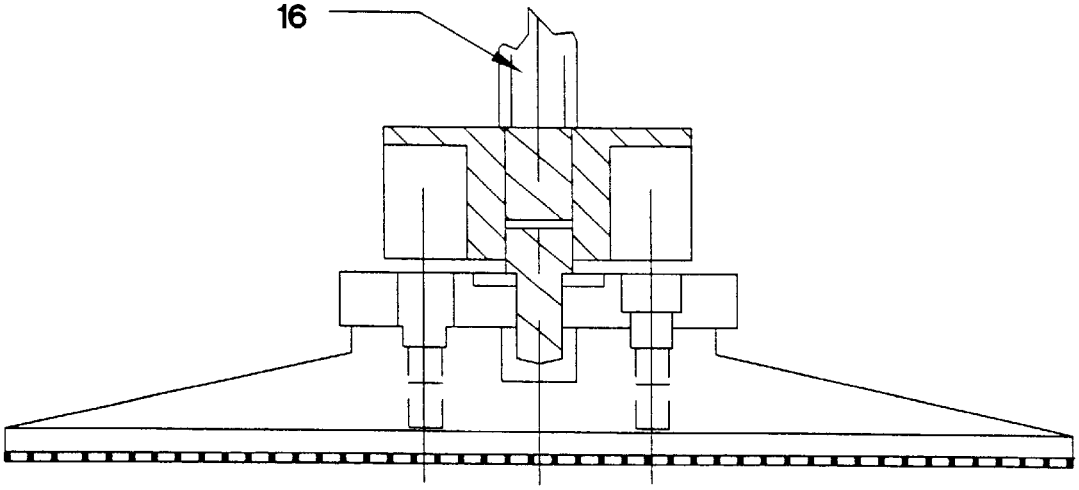
FIG. 1 C (PRIOR ART)
FIG. 1C is a cross-sectional view of a portion of the conditioner assembly of FIG. 1A.

Referring to FIGS. 1A through 1C, there is shown a cross-section of conditioner assembly 10 prior to the present invention. Conditioner assembly 10 includes air cylinder 11, needle valves 12, load cell 13, rotation pulley 14, bearings and spline assembly 15, drive shaft 16 and end effector 17. Conditioner assembly 10 is to enhance polish removal rate by conditioning the pad. In this manner, the pad may be conditioned to enhance CMP. End effector 17 can be a brush, a diamond pad, and the like. Conditioner assembly 10 sweeps back and forth across a CMP pad for conditioning the pad. Air cylinder 11 supplies a downward force which is transmitted through drive shaft 16 to end effector 17. Additionally, end effector 17 may be rotated, oscillated, vibrated, and the like as explained in more detail elsewhere herein. The pad is typically conditioned in order to maintain a consistent polish rate. Such conditioning may occur while one or more substrate assemblies is polished (in situ polishing) or when no substrate assembly is present.

Air cylinder 11 exerts downward force in direction 18 at a controlled speed by valves 12 for applying force onto load cell 13. Load cell 13 is a forced transducer converting the downward force into an electrical signal. Force from load cell 13 is applied to shaft 16 to exert a downward pressure onto end effector 17. Also, rotation pulley 14 is coupled to a motor, described in more detail elsewhere herein, in order to provide rotational force of shaft 16 for rotating end effector 17. A problem with conditioner assemblies 10 is the excessive mechanical parts employed. In particular, rotation pulley 14, and bearings and spline assembly 15 tend to corrode or oxidize from being exposed to wet and fume environment of the polishing chamber. This corrosion causes a binding on shaft 16. Because load cell 13 only detects downward force from air cylinder 11, it will not detect the force lost after cell 13 owing to friction caused by binding. Consequently, force provided from air cylinder 11 will not completely reach end effector 17 owing to such corrosion, and load cell 13 will not indicate that additional downward force was needed. Thus, load cell will not accurately indicate the amount of force being exerted by end effector 17. Moreover, owing to the way that assembly 10 had to be repaired, it was necessary that it be disassembled from end effector 17 toward bearings and spline assembly 15. This is a significant disassembly, owing to corrosion and the way in which the assembly is attached to the CMP device, including its mechanical complexity. Most of this disassembly was done in the cleanroom. Consequently, particulate and lubrication contamination from both the disassembly and the corrosion typically accompanying such disassembly created a cleanliness problem.

Figure 2:
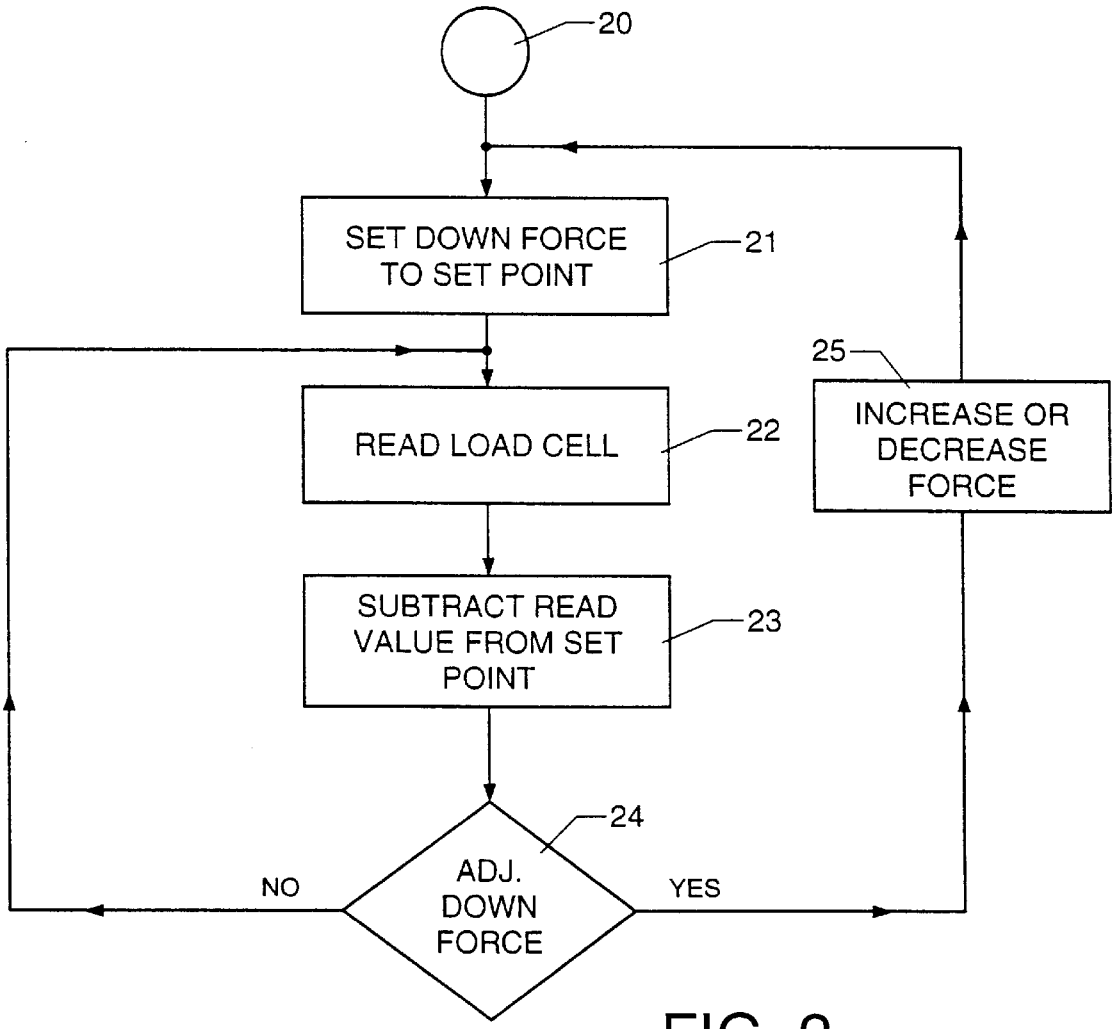
FIG. 2 (PRIOR ART)
FIG. 2 is a flow chart for a conditioner assembly prior to the present invention.

Referring now to FIG. 2, there is shown a flow chart for a conditioner assembly 10 prior to the present invention. The process initiates at step 20. At step 21, the down force is set to the down force set point. In other words, air cylinder 11 is set to a predetermined down force value. At step 22, the force applied from air cylinder 11 is read. In other words, load cell 13 reads the downward force applied. At step 23, the force read at step 22 is subtracted from the set point of step 21. At step 24, it was determined whether or not an adjustment needed to be made in the downward force. In other words, it was determined whether or not air cylinder 11 should increase or decrease the downward force. If no, the process would revert back to step 22 to continue the feedback loop. If yes, then the process would go to step 25, where the downward force was adjusted, either increased or decreased, and then returned to the feedback loop pattern by returning to step 20.

Figure 3:
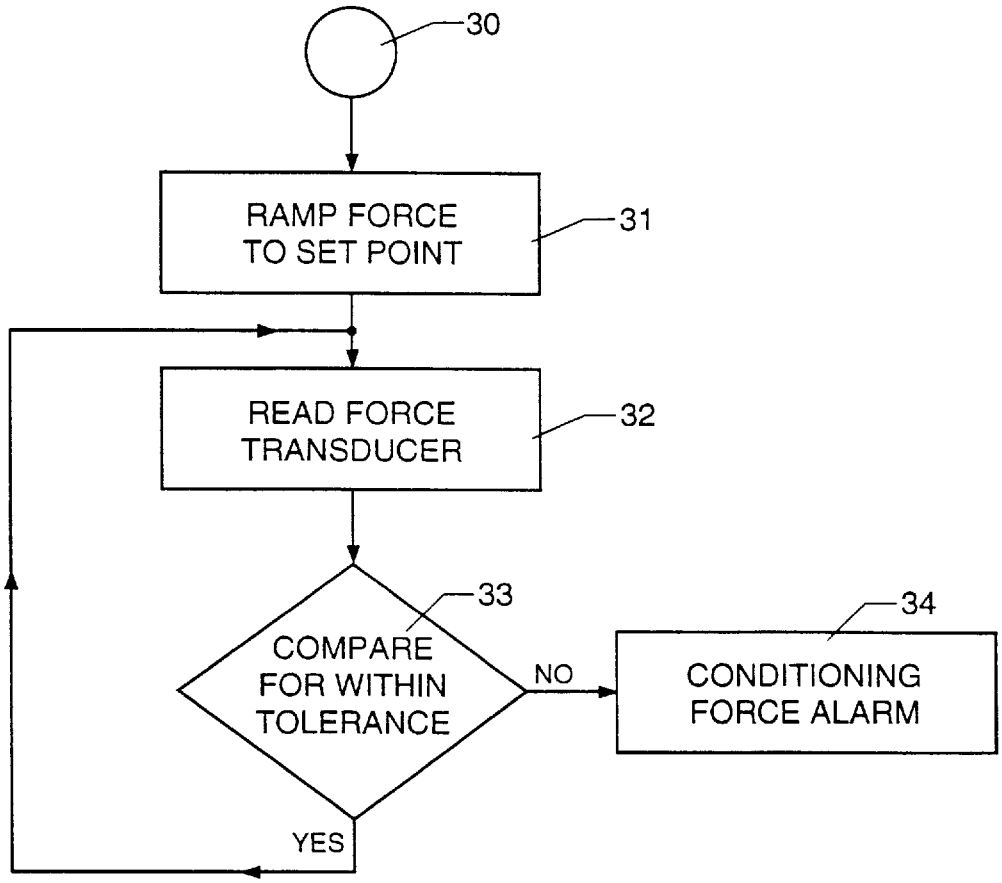
FIG. 3 is a flow chart for ramping and force checking in accordance with the present invention.

Referring now to FIG. 3, there is shown a flow chart for ramping and force checking in accordance with the present invention. The process is initiated at step 30. At step 31, the upward or downward force is ramped to a set point eliminating need for valves 12. At step 32, the force is read from load cell 13. At step 33, the set value, set at step 31, is compared to the read value, read at step 32. If this value is within a tolerance, then there is no error in the system, and the process is repeated at step 32. If the value is outside a tolerance, then there is an error and the process continues at step 34. At step 34, a conditioner force alarm occurs. This represents a difference in approach from that shown in FIG. 2. This difference in approach is also illustrated in the block diagram of FIG. 4.

Figure 4:
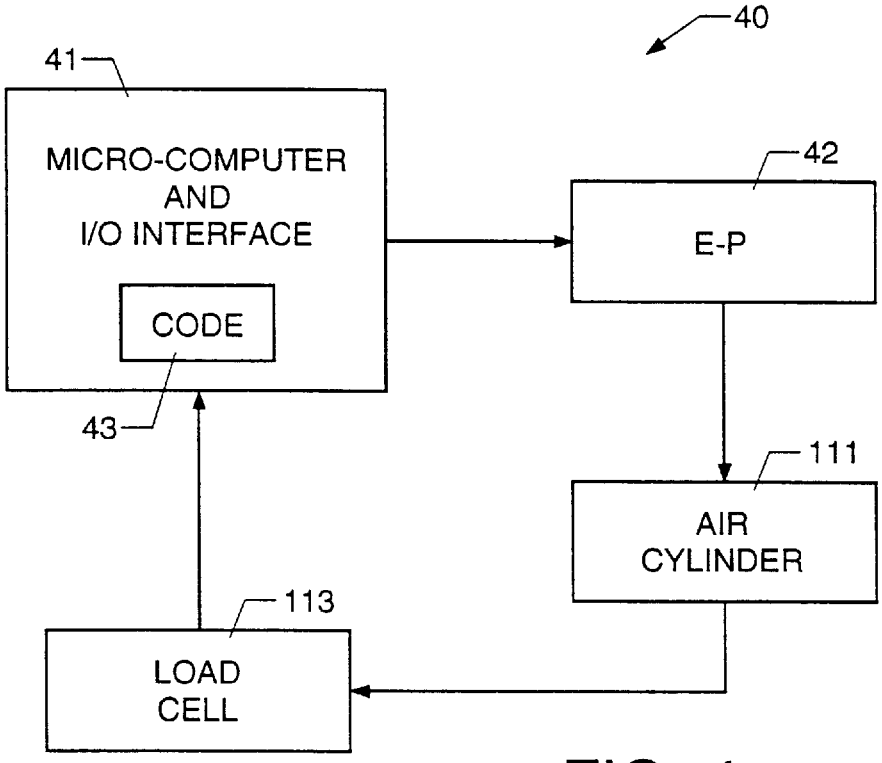
FIG. 4 is a block diagram of a system in accordance with the present invention.

Now referring to FIG. 4, there is shown a block diagram of system 40 in accordance with the present invention. System 40 includes a microcomputer and I/O (input/output) interface (microcontroller) 41. Microcontroller 41 provides information to electronic/pressure regulator (E-P) 42. Prior to the present invention, the E-P regulator was remotely located which made troubleshooting difficult and degraded pressure response time. Regulator 42 regulates air pressure to air cylinder 111. Air cylinder 111 converts air pressure into upward or downward force. This force is sensed by load cell 113. Load cell 113 converts force into a signal which may be read by microcontroller 41. Microcontroller 41 includes code 43. Code 43 may be code associated with the flow chart of FIG. 3. Code 43 may be embodied in any of a variety of well-known means, including but not limited to software and firmware. This allows microcontroller 41 to determine if upward or downward force is within acceptable limits, verifying that all the components are working correctly.

Therefore, prior to the present invention, if there was a malfunction in the system, the micro computer would continue to increase the force, as indicated by the flow chart of FIG. 2. However, in accordance with the present invention, if a particular air pressure is provided from regulator 42, then air cylinder 111 repeatedly, within limits, provides a same up or down force. Load cell 113 is in place to verify that air cylinder 111 is working within acceptable limits, and provide an alarm should the I/O, regulator 42, cylinder 111, or load cell 113 go out of range. This allows for detecting a malfunctioning system as opposed to providing additional pressure, and thus additional force, for a system operating improperly. Thus, the present invention acts as a check loop as opposed to a servo control loop.

Figure 5A:
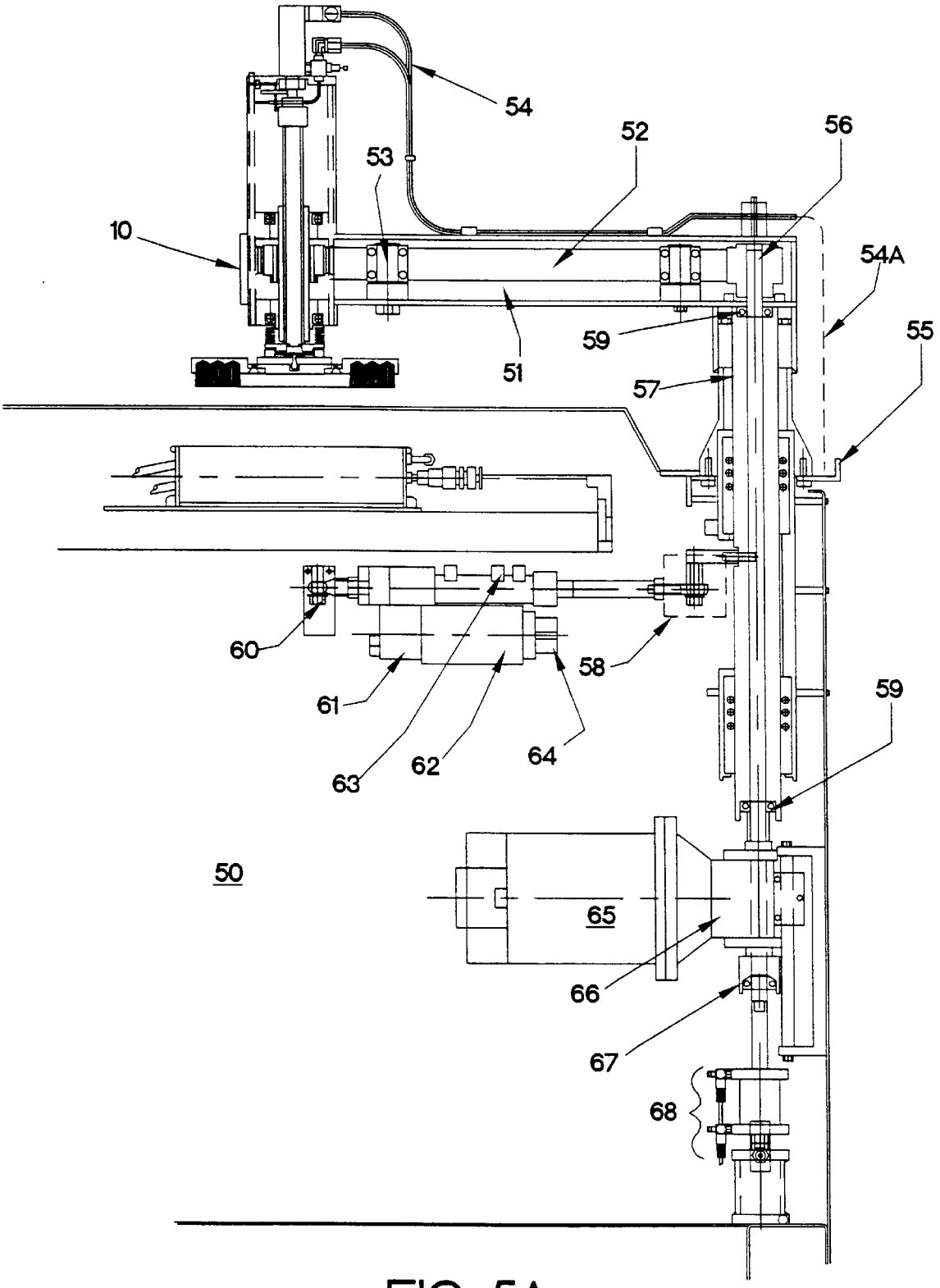
FIG. 5A (PRIOR ART)
FIG. 5A is a cross-sectional view of a pad enhancement conditioner assembly prior to the present invention.
Figure 5B:
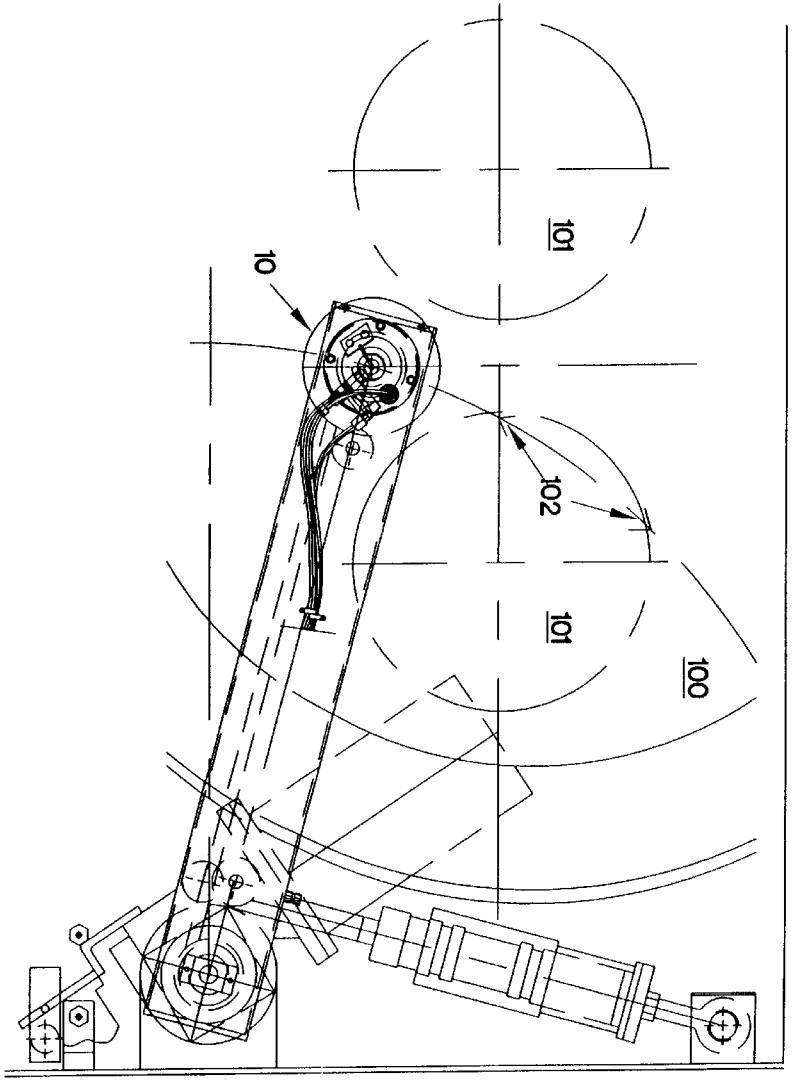
FIG. 5B (PRIOR ART)
FIG. 5B is a top elevation view of the pad enhancement conditioner assembly of FIG. 5A.
Figure 5C:
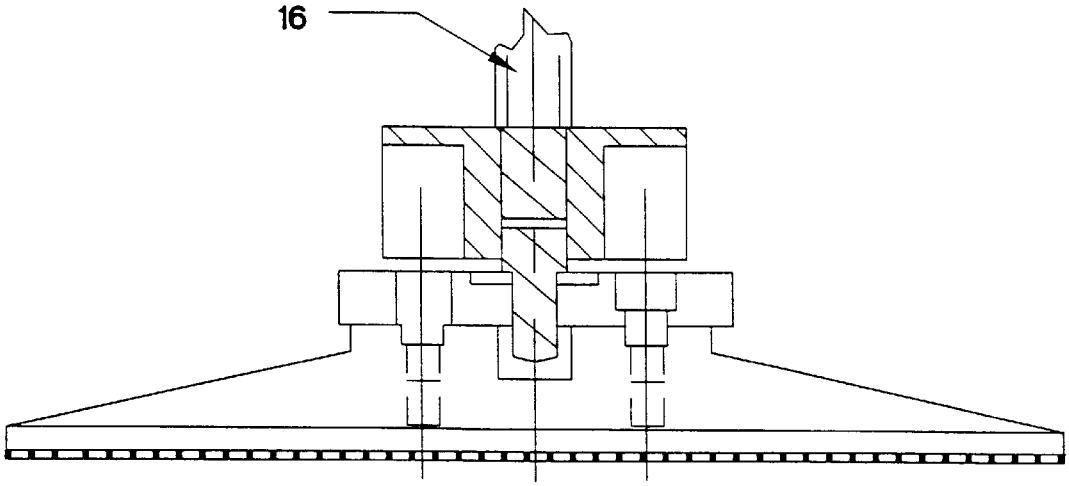
FIG. 5C (PRIOR ART)
FIG. 5C is a cross-sectional view of a portion of the conditioner assembly of FIG. 5A.

Referring now to FIGS. 5A through 5C, there is shown a cross-sectional view of pad enhancement conditioner assembly 50 prior to the present invention. Assembly 50 includes cantilever arm 51. Arm 51 is for moving assembly 10 across a pad 100 before polishing substrate assemblies 101. In such case, arm 51 moves in an arcuate direction 102. Additionally, assembly 50 includes rotation belt 52. Belt 52 is for rotating pulley 14 of assembly 10. Also included in assembly 50 is belt idler 53. Additionally, air lines and cable 54 are provided to assembly 10 for providing air to cylinder 11 and receiving information in the form of an electric signal from load cell 13. As indicated by dashed line 54A, lines 54 typically go below deck 55 through feed through connectors, requiring the connectors at the end of lines 54 to be disassembled before removal. Deck 55 refers to the level of the polishing platens of the CMP machine. Assembly 50 also includes center rotation shaft 56 and sweep shaft 57. Shaft 56 is for providing rotation to belt 52, and sweep shaft 57 is for sweeping arm 51. Shafts 56, 57 form a coaxial combination which is supported at either end by bearings 59 for maintaining shaft 56 centered to shaft 57.

Shafts 56, 57 pass below deck 55. Attached to shaft 57 is lever, arm and rod end assembly 58. This transfers motion from linear actuator assembly 61. Linear actuator assembly 61 includes sweep motor 62 and limit switch 63. Also, a rod end 60 is included. Sweep motor 62 is a brush motor, which creates a problem generating significant brush dust particulate. Also included is encoder 64 for indicating position of linear actuator assembly 61. Limit switch 63 provides for park, arc in sweep, and arc out sweep. Therefore, to make an adjustment for conditioning, it would be necessary to go underneath the deck to set switch 63. These switches 63 are now just used for indexing devices, as encoder 64 provides these three indications to microcontroller 41 for adjustment. There is a significant number of mechanical linkages between encoder 64 and the end of arm 51 which contributes to poor reliability and high particle generation.

Shaft 56 goes below deck 55 and is coupled to motor 65 via gearbox 66. Rotation motor 65 and gearbox 66 cause shaft 56 to rotate which in turn turns belt 52, whereas sweep motor 62 moves arm 51 in direction 102. Gearbox 66 is an oil filled type which may leak, causing contamination. Rotation stop bearing 67 stops rotation from going below to up/down cylinder and control valves assembly 68. Assembly 68 moves the entire assembly 10 through arm 51 up and down for moving to or from a home position to conditioning position.

Figure 6:
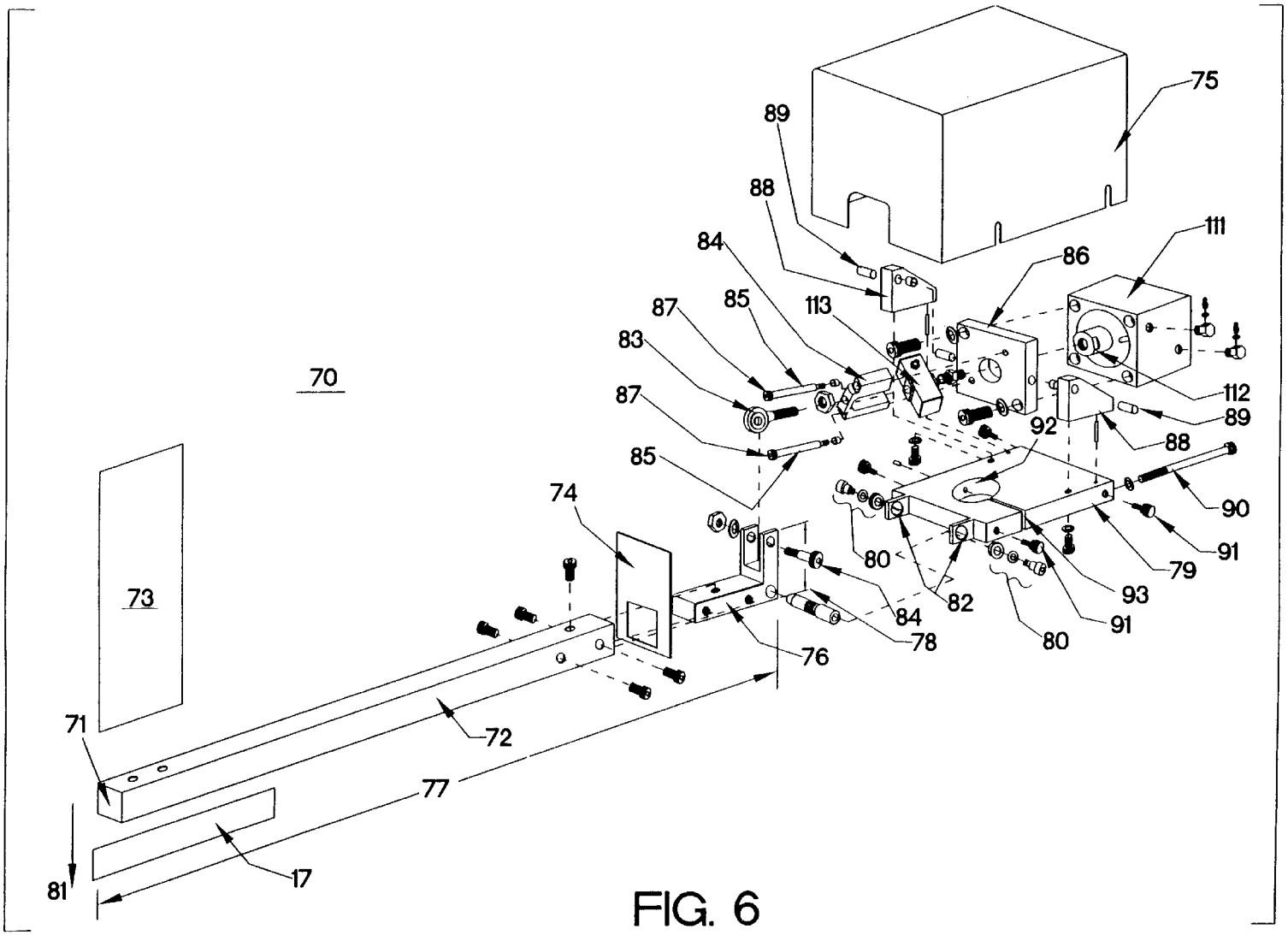
FIG. 6 is an exploded view of a turret assembly in accordance with the present invention.

Referring to FIG. 6, there is shown an exploded view of turret assembly 70 in accordance with the present invention. Assembly 70 may have attached to distal end 71 of arm 72 a motor 73 for providing motion to end effector 17 which is also attached to distal end 71 of arm 72. Motor 73 is to provide motion, rotation, oscillation, vibration, and the like, such as to end effector 17. Rubber flap 74 provides sealing of arm 72 to cover 75. As explained elsewhere herein, CMP typically employs chemicals which have a corrosive effect. Rubber flaps 74 therefore protects the mechanics covered by cover 75.

Arm 72 is hollow and allows for cabling to be provided internal to it. Attached to arm 72 is fulcrum arm 76. Length of arm 71 and 76 in combination provide a length 77, and height of fulcrum arm 76 provides a length 78. The ratio of length 77 to 78 allows for a reduction in force applied at distal end 71 with respect to that which is delivered from air cylinder 111. By comparison to assembly 10 of FIG. 1, air cylinder 11 providing one pound of output force with a binding force of one half pound owing to corrosion of assembly 15 results in one half pound of force being applied to end effector 17, or a loss of one half pound of force. However, for example, as the mechanical parts which may corrode and cause a binding or friction force reduction in the present invention pivot about pivot shaft 78, a ten pound force from air cylinder 111 will apply a one pound of force at distal end 71 of arm 72 for a ten to one ratio, less any binding force. If in the example above, the binding force was one half pound, the present invention provides a ten to one reduction, or the binding force has an equivalent effect of 1/20 of a pound at distal end 71. Consequently, in the above example, the prior technology has a 50% change in process with respect to a half pound reduction as opposed to the present invention which has a 5% change in process. Consequently, the present invention is able to maintain higher repeatability and consistency of processing.

Arm 76 is attached to turret base 79 via pivot bearings 80. Pivot bearings 80 are the only bearings in assembly 70 which see a significant amount of motion. Consequently, it would take a severe binding of bearings 80 in order to effect any downward force 81 at distal end 71 of arm 72. Tabs 82 extrude from turret base 79. Tabs 82 are made significantly thin for flexing inward. In this manner, when pivot bearings 80 are assembled for attaching arm 76 to base 79, tabs 82 flex to main preload on bearings 80. Thus, tabs 82 are spaced wider than the width of arm 76.

Rod end 83 is coupled to arm 76 via bolt 84. Rod end 83 goes through a U-shaped block, stop block 84. Stop block 84 guides the force from cylinder 111 to track smoothly along guide shafts 85.

Shafts 85 may be shoulder bolts with bushings inside and having heads at a distal end. Shafts 85 prevent unwanted rotation of load cell 113 and shaft 112 of cylinder 111, and thus avoids binding of load cell 113 and shaft 112. Thus, stop block 84 provides bearing surfaces for guide shafts 85 and keeps cylinder shaft 112 partially extended out of cylinder 111 when shaft 112 is completely retracted. As load cell 113 is located inside the U-shaped portion of stop block 84, when cylinder 111 retracts shaft 112 all the way back, because load cell 113 is mounted to the distal end of stop block 84, it does not come in contact with mounting plate 86. Thus, because stop block 84 prevents complete retraction of shaft 112 of cylinder 111, load cell 113 measures a pulling of shaft 112 for a measurable force in the negative direction. In other words, assembly 70 can determine whether arm 72 is an up or down position by the direction of force exhibited on load cell 113. A negative force indicates that arm 72 is in the up position. A positive force indicates that arm 72 is in the down position. As load cell 113 feeds information back to microcontroller 41, code 43 is programmed to identify the direction or sign of the force exhibited in order to determine position of arm 72. Also, stop block 84 prevents shaft 112 of cylinder 111 to fully extend for applying downward force. Heads 87 of shafts 85 engage stop block 84 prior to complete extension of shaft 112. Normally, cylinder 111 will not extend shaft 112 so far as to have heads 87 engage stop block 84. However, during handling of assembly 70, the person holding it at arm 72 could extend shaft 112 fully such that an amount of force in excess of the maximum limit of load cell 113 could be applied if not for heads 87. However, heads 87 prevent the complete extension of shaft 112 such that such handling of arm 72 would not damage load cell 113. Moreover, if end effector 17 is not attached to arm 72, heads 87 prevent full extension of shaft 112 such that arm 72 does not scrape pad 100.

Cylinder 111 is fixedly attached to plate 86. Plate 86 is attached to base 79 via support blocks 88. Bearings 89 are for pivotally attaching cylinder 111 and plate 87 to base 79 and support blocks 88. This is to account for limited travel or rotation of rod end 83 as angle fulcrum arm 76 changes. In other words, as air cylinder 111 rocks up and down with movement of arm 72 and 76, it pivots with respect to turret base 79 such that rod end 83 and shaft 112 stay in horizontal alignment.

Figure 7A:
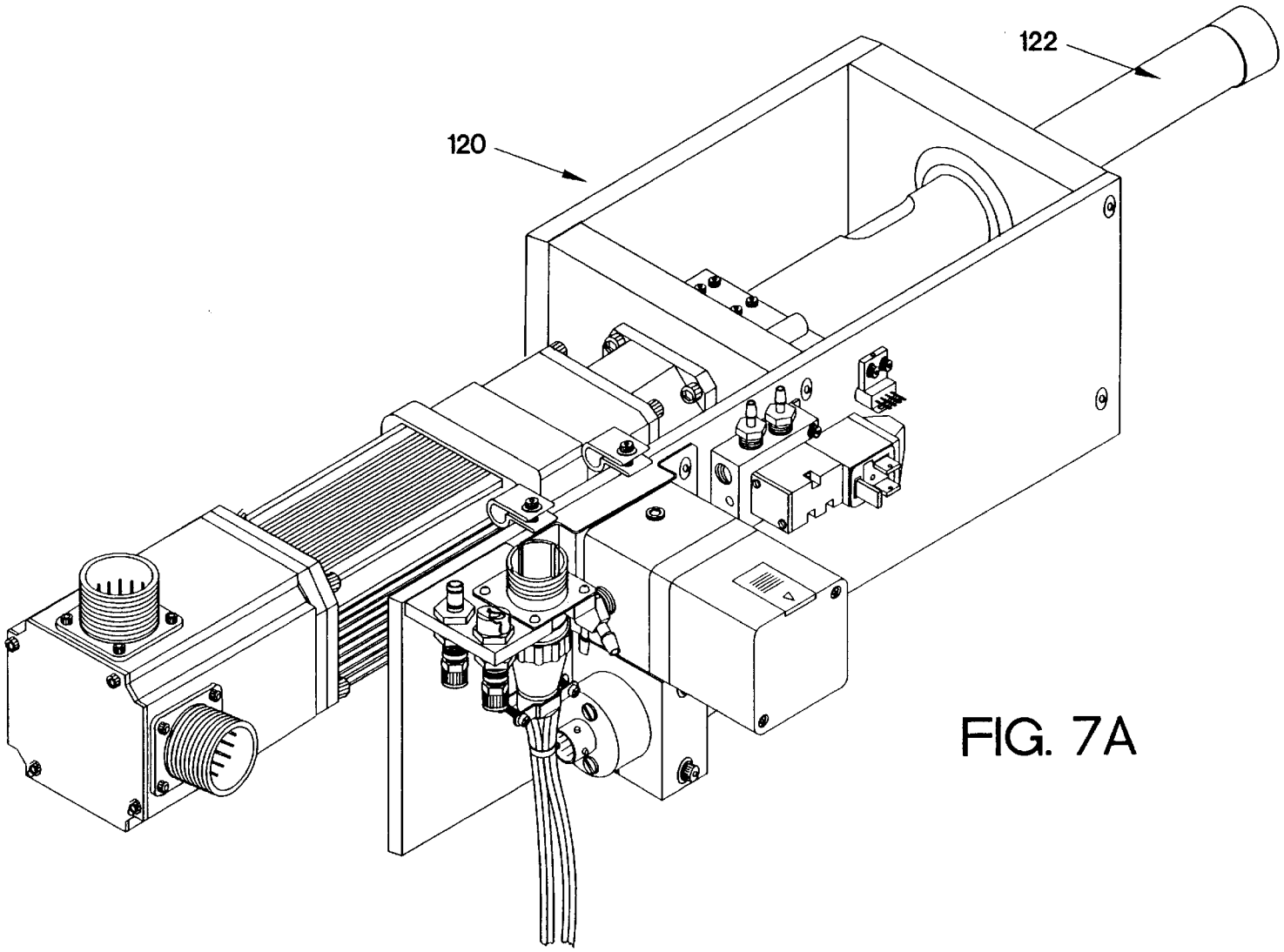
FIG. 7A is perspective view of a drive assembly in accordance with the present invention.
Figure 7B:
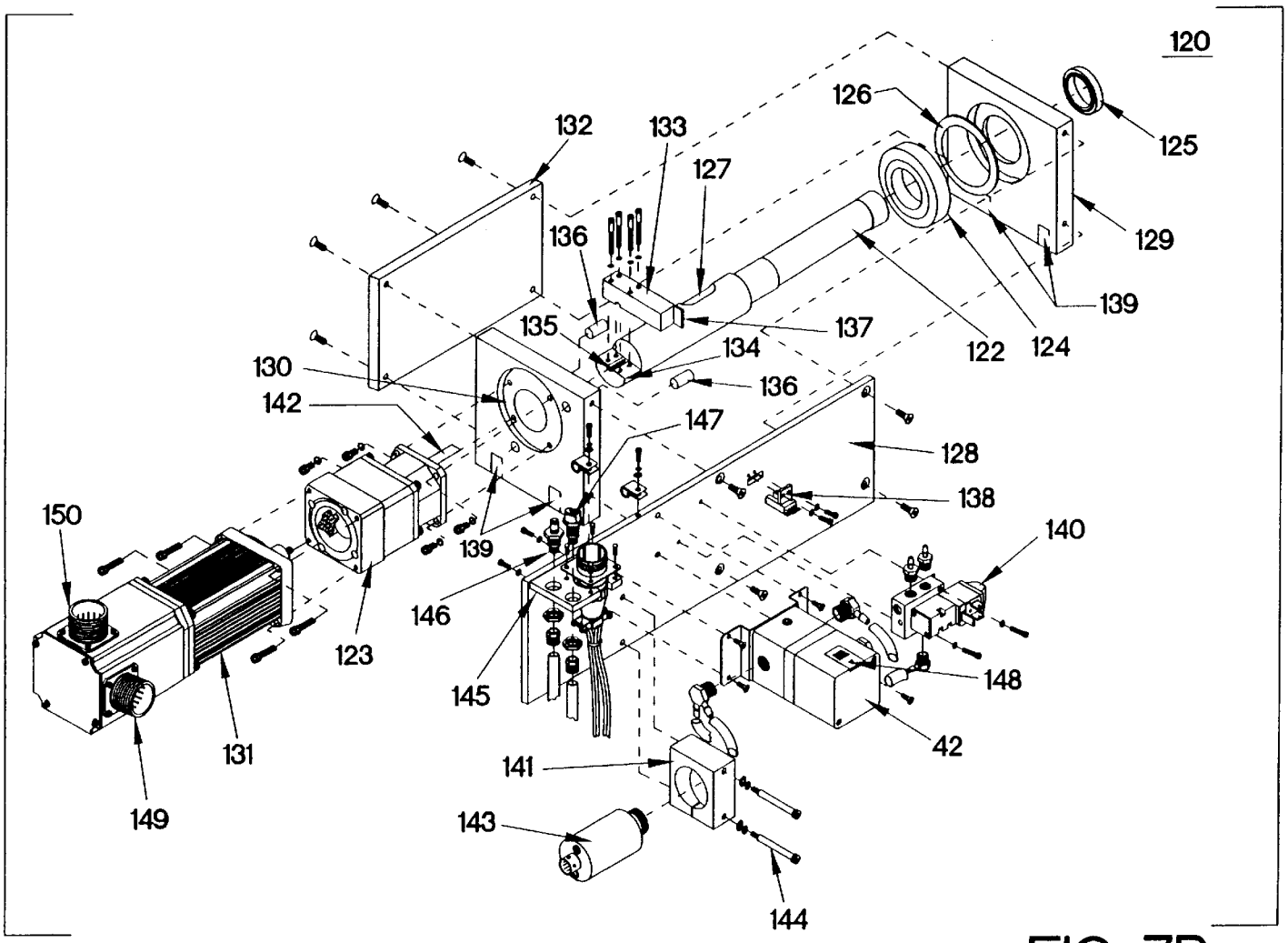
FIG. 7B is an exploded view of the drive assembly of FIG. 7A.
Figure 7C:
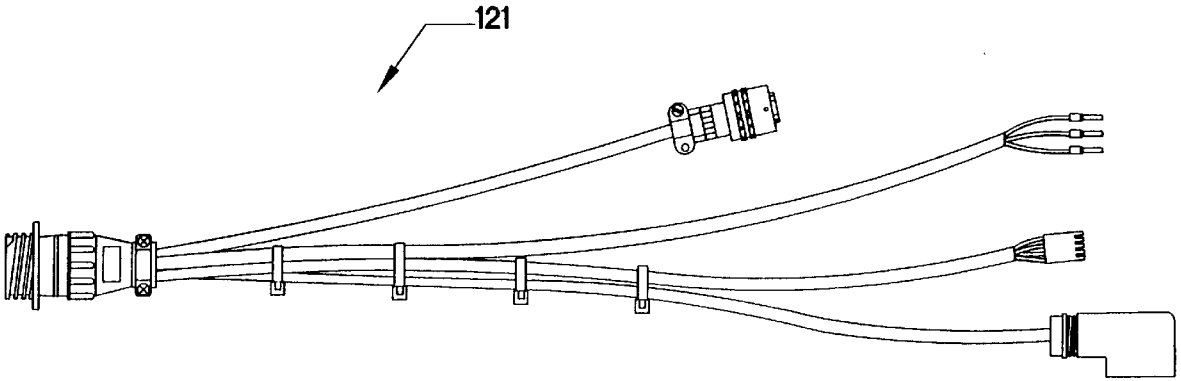
FIGS. 7C and 7D are side plan views of a cable assembly in accordance with the present invention.
Figure 7D:
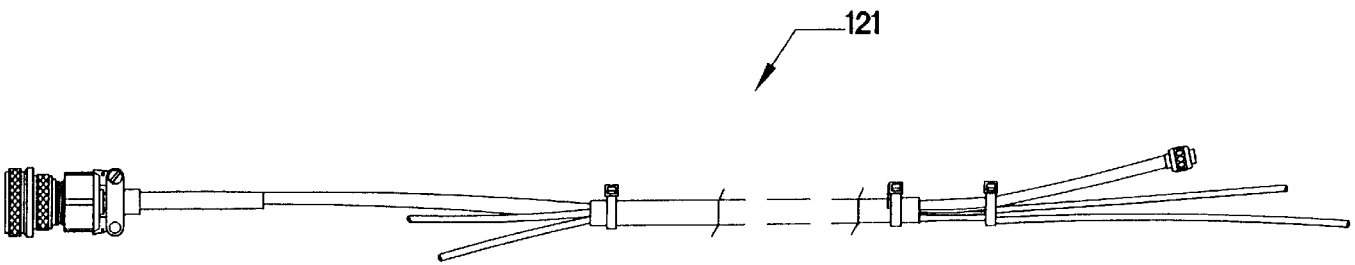

Drive assembly 120 (shown in FIGS. 7A and 7B), is mounted up through hole 92 of base 79. Slot 93 of base 79 is to key a shaft which rotates (sweeps) assembly 70 over a pad for example. Pin 201 is for indexing assembly 70 to mating slot in drive assembly 120. Bolt 90 is for tightening slot 93 to lock the key of the shaft. Screws 91 may be partially removed for removing cover 75. Quick disconnects attach to cylinder 111 and cell 113 allow pneumatic and electrical connections to be removed quickly. Therefore, assembly 70 is essentially a modular design which may be easily removed from a drive shaft and CMP machine for replacement with an entirely separate assembly 70.

Referring now to FIGS. 7A through 7D, there are shown perspective and exploded views of drive assembly 120 in accordance with the present invention. Assembly 120 includes drive shaft 122. Drive shaft 122 is a single shaft which goes all the way down to gearbox 123 without additional linkages interposed. Shaft 122 is supported at one end by gearbox 123 and at a distal end by bearing 124. Seal 125 is employed to protect against exposure from possible liquid leak through deck 55. Spring washer 126 provides bearing 124 with preload to keep the balls preloaded in one direction, and allows such preload to exist without attempting to shim assembly 120 or machine plates of assembly 120 to extreme precision. Shaft 122 is hollow to cable exit hole 127. This allows cabling for turret assembly 70 be routed completely internally to the combination of assemblies 70 and 120 which form a conditioner in accordance with the present invention. As an opening in shaft 22 is accessible when shaft 22 is mounted to hole 92 of base 79, cabling from load cell 113 and cylinder 111 may be routed within cover 75 through shaft 122 to opening 127. Such cabling may exit at that location for coupling to devices mounted along front plate 128.

Cable assembly 121 may be routed up through hole 127. Cable assembly 121 includes two pneumatic lines for cylinder 111 for up and down motion, and contains a cable for the load cell signal. Moreover, shaft 122 has been enlarged to allow room for additional pneumatic cables and/or additional electrical cables. Such additional cables might be used for running a brushless DC motor attached to distal end 71 of arm 72 for example.

Upper plate 129, lower plate 130, rear plate 132, and front plate 128 form a housing for shaft 122. Such housing supports shaft 122 by attachment of bearing 124 and gearbox 123. Attached to gearbox 123 is motor/encoder 131. Motor 131 is preferably a brushless motor to reduce particulate contamination generation. Assembly 120 is substantially a direct drive mechanism with the exception of gearbox 123. Gearbox 123 is a low back lash gearbox for providing accurate relation between motor/encoder assembly 131 and effector 17. Gearbox 123 is clamped to shaft 122 with clamp/flag 133. Clamp 133 and backing clamp 134 pinch shaft on to collar 135 of shaft 122.

Figure 8:
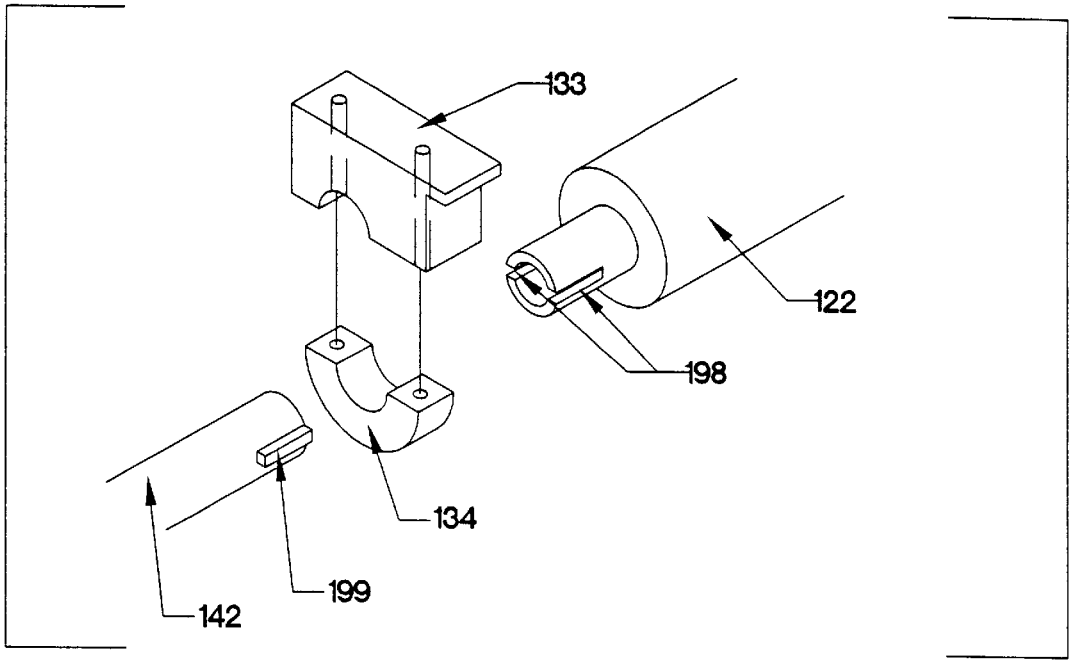
FIG. 8 is an exploded view of a clamp/flag in accordance with the present invention.
Figure 9:
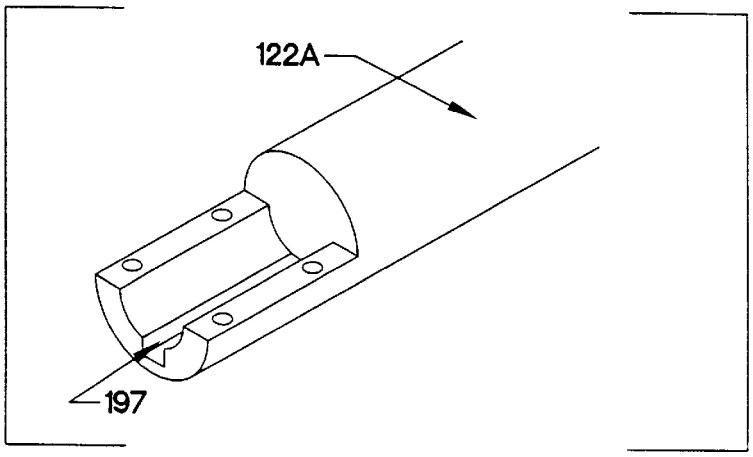
FIG. 9 is an exploded view of an alternate embodiment of a shaft in accordance with the present invention.

Referring to FIG. 8, there is shown an exploded view of clamp/flag 133 in accordance with the present invention. Shaft 142 of gearbox 123 engages shaft 122. Particularly, key stock 199 engages slot 198 of shaft 122 and extends between clamps 133 and 134. Alternatively, referring to FIG. 9, there is shown an exploded view of shaft 122A in accordance with the present invention. Shaft 122A may be employed to engage key stock 199 at slot 197, and thus clamp 134 may be omitted.

With renewed reference to FIGS. 7A through 7D, as gearbox 123 has a key, it locks orientation of flag 133 such that it does not slip. Clamp/flag 133 is mounted with screws such that it is fixedly attached to shaft 122. Besides functioning to clamp shaft 122 to gearbox 123, clamp/flag 133 limits motion of shaft 122 within acceptable limits by attaching stop pins 136 to bottom plate 130. Thus, clamp/flag 133 abuts pins 136 as a form of stop for shaft 122. This prevents damage to the assembly including but not limited to the motor/encoder assembly 131, turret assembly 70, and cabling 121. Tab 137 of clamp/flag 133 is for optical sensor 138 mounted to front plate 128. Sensor 138 is for indexing motor encoder to a known position which is usually the park or home position. In prior technology, magnetic switches mounted on linear actuator assembly 61 were employed to determine whether or not the device was in the home or parked position. However, optical sensors are much more accurate, and the linear actuator assembly 61 was so far removed from the actual movement of the device, it introduced errors. Whereas the present invention provides a flag solidly attached to shaft 122 which is in close proximity to optical sensor 138. Moreover, by using clamp/flag 33 for attaching a gearbox 123, acting as a stop for movement of shaft 122 and as an interrupt flag for the optical sensor. The number of parts was significantly reduced over prior technology. Notably, front plate 128 extends further toward motor/encoder 131 than rear plate 132. This provides additional mounting surface along front plate 128. Mounted to front plate 128 is up/down solenoid 140. Solenoid 140 directs air from regulator 42 to cylinder 111 causing it to extend or retract, thus raising or lowering arm 72. Solenoid 140 is controlled by code in microcomputer 41. The air supply which feeds solenoid 140 is controlled by E-P regulator 42. Having regulator 42 directly before solenoid 140 and in close proximity thereto, allows for regulator 42 to sense the pressure near to the device it is being delivered to, namely, cylinder 111. Preferably, regulator 42 is of the self-venting type. This allows for the pressure to be controlled in cases where there is an overshoot of a set point. Moreover, if someone were to apply excess pressure onto arm 72, regulator 42 would vent excess pressure or to maintain the desired pressure. A small orifice to atmosphere may be installed in the regulator 42 output. This would allow the regulator 42 to control pressure of continuous flow rather than be required to stop a flow when pressure set point is reached. Not only can downforce be controlled, but up force can also be controlled by switching solenoid 140. This is because solenoid 140 is after regulator 42, and thus it may be switched for supplying controlled pressure to either raise or lower arm 72. Moreover, needle valves 12 of the prior technology used to control cylinder speed have been avoided entirely, by ramping regulator 42 pressure to zero, then switching solenoid 140 and ramping regulator 42 to desired up or down depending on position of solenoid 140 needle valves are not employed. By electronically controlling the ramping of the forces, more accuracy is instilled in the present invention over prior technology which had needle valves 12 which would vary from system to system and from time to time. Moreover, such operation of needle valves was very subjective dependent upon each individual operator.

Also mounted to front plate 128 is load cell amplifier 143. Cell 113 provides a low voltage signal, typically in the millivolt range. Therefore, amplifier 143 amplifies that signal. Prior to the present invention, the amplifier for load cell 13 was mounted on the frame of the CMP machine and was not part of the arm assembly as it is in the present invention with the mounting of amplifier 143. By having amplifier 143 in closer proximity to cell 113, a more reliable signal may be driven over a cabling period. Moreover, owing to the modularity of the present invention, when assembly 120 is removed from a CMP machine, load cell amplifier 143 goes with it. This is important for diagnostic purposes, as load cell 143 is a component which might fail in an arm or conditioner assembly.

Moreover, mounting block 141 for amplifier 143 is typically made out of plastic to avoid corrosion and allows for quick removal of amplifier 143 with loosening of bolt 144. Another thing which allows for quick disassembly is connector plate 145 which has mounted thereto air supply 146 and test port 147. Ports 146, 145 are preferably quick disconnects for easy dissembling. Test port 147 allows for a reference pressure gauge to be attached for calibration. Additionally, regulator 42 includes calibration controls 148 which allow for adjustments of zero and span calibration. Code 43 bases its force set point from a formula that accounts for E-P pressure range, cylinder area, arm lever ratio and tare weight owing to devices on distal end 71 of arm 72. This allows for an open loop system, because for each system there is no difference. In other words, for example, code value 1000 equal to one volt at I/O, one volt may equate to 10 PSI at regulator 42, which will equate to one pound at end effector 17. Therefore, a technician verifying operation of the system will know that this ratio is always true for the system, and thus correct opertation can easily be verified. Notably, load cell 113 is not calibrated. Rather, a known pressure is applied to test port 147. The pressures, for example, one pound of down force and ten pounds of down force, are verified. Computer 42 variables are adjusted to cause reading from load cell 13 to match force set point from computer 42. Therefore, under a known, controlled good operating condition, forces may be quickly calibrated for the correct feedback for if something changes and does not track, an alarm will sound. Feedback from load cell 113 is not being used to modulate downforce or track downforce, rather it is just being used to make sure that the downforce has met a set point, and that arm 72 is up or down. However, cell 113 does indicate exactly what is going on at distal end 71 of arm 72, allowing downforce to reach an actual set point before trying to sweep which is significant for repeatable operations as opposed to sweeping before reaching a set point.

Preferably all components are made out of non-corrosive materials. Motor/encoder assembly 131 has two connectors 149 and 150. Connector 149 and 150 are for motor power and encoder cabling, and are of the seal-type connector. Notably, the encoder portion of assembly 131 is directly mounted on an extended portion of the shaft of the motor of assembly 131 such that resolution between encoder counts and motor are very reliable and accurate. Preferably, motor of motor/encoder assembly 131 gives a high number of counts per revolution for precision. This allows for more accurate resolution of positioning. Notably, gear reduction provided by gearbox 123 is significantly high. For example, it is anticipated that gearbox 123 would be in the range of 70:1 or 100:1 ratios. This high gearbox reduction basically amplifies the number of counts of assembly 131. This again further increases accuracy and precision.

The present invention has been particularly shown and described with respect to certain preferred embodiments and features thereof. It should be readily apparent to those of ordinary skill in the art that various changes and modifications in form and detail may be made without departing from the spirit and scope of the present invention as set forth in the appended claims.

What is claimed is:

1. A control system for a conditioner for conditioning a pad for chemical-mechanical-polishing, the conditioner having an end effector attached to an arm assembly and having a platen, the platen configured to support the pad, the control system comprising:

a microcontroller;

an electronic-pressure regulator in electrical communication with the microcontroller and configured to regulate air pressure;

an air cylinder configured to convert air pressure into directionally oriented force;

the electronic-pressure regulator configured to regulate air pressure into the air cylinder;

an arm configured to receive the directionally oriented force in a first direction and to apply the directionally oriented force in a second direction different from the first direction;

the end effector configured to condition the pad at least in part using the directionally oriented force applied in the second direction;

a load cell configured to sense the directionally oriented force applied in the first direction and to convert the directionally oriented force sensed into an electric signal, the load cell in electrical communication with the microcontroller to provide the electric signal thereto; and the microcontroller configured to provide check loop control.

2. A control system, as in claim 1, wherein the microcontroller includes code for processing of the electric signal.

3. A control system for a conditioner for conditioning a pad for chemical-mechanical-polishing, the conditioner having an end effector attached to an arm assembly and having a platen, the platen configured to support the pad, the control system comprising:

a microcontroller having code;

an electronic-pressure regulator in electrical communication with the microcontroller and configured to regulate air pressure;

an air cylinder configured to convert air pressure into translational force;

the electronic-pressure regulator configured to regulate air pressure to the air cylinder;

the arm having a proximal section and a distal section, the proximal section configured to receive the translational force in a first direction, and the distal section configured to apply the translational force in a second direction;

the end effector configured to condition the pad at least in part using the translational force applied in the second direction;

a load cell configured to sense the translational force in the first direction from the air cylinder and convert the translational force sensed into an electric signal, the load cell in electrical communication with the microcontroller to provide the electrical signal thereto;

the microcontroller configured to process the electrical signal using the code;

the code and the microcontroller in combination configured to determine the translational force supplied by the cylinder in response to the electric signal; and the microcontroller configured to control the electronic-pressure regulator to control the translational force supplied by the air cylinder.

4. A conditioning device for conditioning a pad on a platen, comprising:

a turret assembly;

an arm pivotally attached to the turret assembly, the arm having a proximal section attached to the turret assembly and having a distal section cantilevered away from the turret assembly;

an end effector operatively attached to the distal section of the arm;

the turret assembly configured to move the end effector between a first position away from the pad on the platen and a second position contracting the pad on the platen, the turret assembly comprising:

a turret base;

a rod having a first portion and a second portion, the first portion operatively attached to the proximal section of the arm;

a cylinder operatively coupled to the turret base, the cylinder having a cylinder shaft;

a load cell operatively coupled to the cylinder shaft, the second portion of the rod operatively coupled to the cylinder shaft and the load cell; and the rod and the cylinder in combination configured to move the distal section of the arm between relatively up and down positions; and a drive assembly having a drive shaft attached to the turret base to rotate the turret base.

5. A conditioning device, as in claim 4, wherein the proximal section of the arm and the distal section of the arm are coupled in angular relation to one another.

6. A conditioning device, as in claim 5, wherein the proximal section of the arm is pivotally attached to the turret base.

7. A conditioning device, as in claim 5, wherein the proximal section of the arm is L-shaped.

8. A conditioning device, as in claim 7, wherein the arm is configured to provide a reduction in the cylinder supplied force at the distal section of the arm.

9. A conditioning device, as in claim 4, further comprising a stop block coupled between the second portion of the rod and the cylinder to limit retraction of the cylinder shaft.

10. A conditioning device, as in claim 4, further comprising a gear box geared to the drive shaft.

11. A conditioning device, as in claim 10, further comprising a motor/encoder coupled to the gear box.

12. A conditioning device, as in claim 10, wherein the drive shaft comprises a first portion and a second portion, the first portion coupled to the second portion by a clamp, the first portion attached to the turret base for rotation thereof, and the second portion geared to the gear box.

13. A method for check loop control of a pad conditioner for conditioning a pad for chemical-mechanical-polishing, the conditioner having an arm pivotally attached to a turret assembly, an end effector operatively attached to said arm, and the pad disposed on a platen, said method comprising:

providing a force actuation mechanism, said force actuation mechanism operatively coupled to exert a force on said turret assembly arm;

ramping said force to a predetermined value and transferring said force through said turret assembly arm to said end effector;

moving said end effector relative to said pad to condition said pad;

determining an amount of said force applied to said turret assembly arm; and periodically comparing said amount of said force applied to said turret assembly arm with said predetermined value to determine if said amount of said force applied is within allowable range.

14. A method, as in claim 13, wherein said amount of said force applied is determined with a load cell.

15. A control system for a pad conditioner for conditioning a pad for chemical-mechanical-polishing, the conditioner having an end effector attached to an arm assembly and having a platen, the platen configured to support the pad, the control system comprising:

a controller;

a regulator operatively coupled to the controller to receive information therefrom and to regulate air pressure in response to the received information;

a first transducer operatively coupled to receive air and to provide translational force in response to the air received;

the arm assembly configured to receive the translational force in a first direction and to apply the translational force in a second direction;

the end effector configured to condition the pad at least in part using the translational force applied in the second direction; and a second transducer operatively coupled to sense the translational force applied and configured to provide to the controller a signal functionally representative of the translational force applied.

16. A control system, as in claim 15, wherein the first transducer is an air cylinder, and the second transducer is a load cell.

17. A control system, as in claim 15, wherein the regulator is an electronic/pressure regulator, and the controller is a microcontroller.

18. A control system, as in claim 15, wherein the controller includes code for operating the control system as a check loop.

19. A control system for a conditioner for conditioning a pad for chemical-mechanical-polishing, the conditioner having an end effector attached to an arm assembly and having a platen, the platen configured to support the pad, the control system comprising:

a controller;

a regulator in electrical communications with the controller;

a cylinder configured to convert pressure into force;

the regulator configured to regulate pressure to the cylinder;

the arm assembly configured to receive the translational force in a first direction and to apply the translational force in a second direction;

the end effector configured to condition the pad at least in part using the translational force applied in the second direction;

a load cell configured to sense the translational force applied in the first direction and to convert the translational force sensed into a signal related thereto; and the controller in electrical communication with the load cell to receive the signal.

20. A control system, as in claim 19, wherein the controller includes a computer and an interface.

21. A control system, as in claim 20, wherein the controller includes code for operation.

22. A conditioning device for a chemical-mechanical-polisher for planarizing a substrate assembly, the chemical-mechanical-polisher having a platen sufficient to support a pad and one or more wafers, the conditioning device comprising:

a turret assembly, the turret assembly having a cylinder, an arm pivotally attached to the turret assembly, the arm having a proximal section, a distal section, and a fulcrum located between the proximal section and the distal section;

an end effector operatively attached to the distal section of the arm;

the cylinder operatively coupled to the proximal section of the arm to move the distal section of the arm between relatively up and down positions;

the turret assembly and the arm in combination configured to move the end effector in a first direction away from the pad and a second direction toward the pad; and the fulcrum configured to reduce force from the cylinder as applied to the pad.

* * * * *